US006425134B1

(12) United States Patent
Huang

(10) Patent No.: US 6,425,134 B1
(45) **Date of Patent: *Jul. 30, 2002**

(54) PROTECTIVE AIR CUSHION GLOVES

(76) Inventor: Ing Chung Huang, No. 218 Cheng Kung Three Road, Nantou City (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/517,293

(22) Filed: Mar. 2, 2000

Related U.S. Application Data

(63) Continuation of application No. 08/876,491, filed on Jun. 16, 1997, now Pat. No. 6,065,150.

(30) Foreign Application Priority Data

Jun. 15, 1996 (TW) ..... 85107199 A

(51) Int. Cl.[7] ..... A41D 13/08
(52) U.S. Cl. ..... 2/20; 2/161.1
(58) Field of Search ..... 2/16, 20, 159, 2/161.1, 413, 163, 22, 24, DIG. 3; 5/655.3, 706; 36/28, 29

(56) References Cited

U.S. PATENT DOCUMENTS 2,640,989 A * 6/1953 Woodward ..... 2/22
3,866,243 A * 2/1975 Morgan ..... 2/413
4,370,754 A * 2/1983 Donzis ..... 2/16
4,411,024 A * 10/1983 Hayes ..... 2/20
4,912,861 A * 4/1990 Huang ..... 36/29
4,945,571 A * 8/1990 Calvert ..... 2/161.1
5,257,418 A * 11/1993 Jaskiewicz ..... 2/20
5,274,846 A * 1/1994 Kolsky ..... 2/16
5,323,490 A * 6/1994 Yarbrough ..... 2/163
5,335,382 A * 8/1994 Huang ..... 5/454
5,345,609 A * 9/1994 Fabry et al. ..... 2/20
5,537,688 A * 7/1996 Reynolds et al. ..... 2/20
5,771,490 A * 6/1998 Reynolds et al. ..... 2/20

* cited by examiner

*Primary Examiner*—Peter Nerbun
*Assistant Examiner*—Katherine Moran
(74) *Attorney, Agent, or Firm*—Bacon & Thomas, PLLC

(57) ABSTRACT

Protective air cushion gloves include hollow 3D straight air cushions for finger backs and a hand back disposed in regular rows inside the glove. Each straight air cushion has sections connected with extensible tubes and inflated with inner pressure to permit the glove to have good flexibility and an air buffer function for protecting every part of a hand, including the joints.

10 Claims, 5 Drawing Sheets

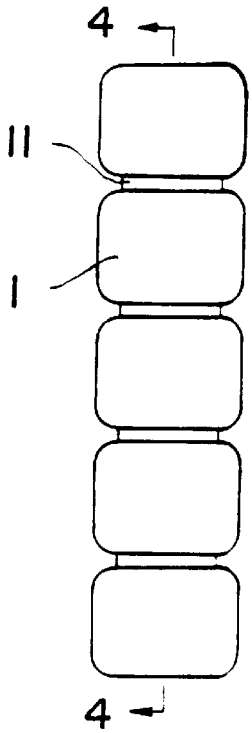
FIG. 2
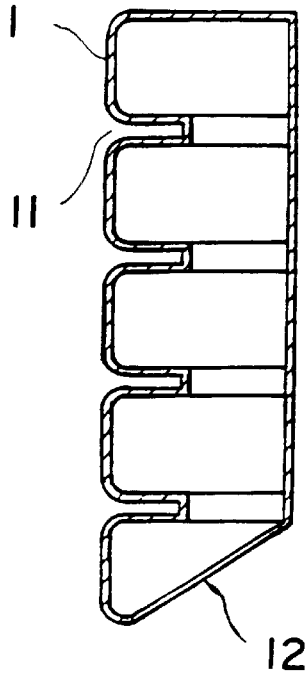
FIG. 4
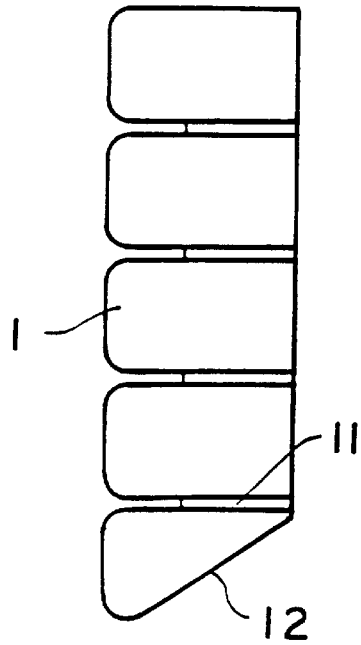
FIG. 3
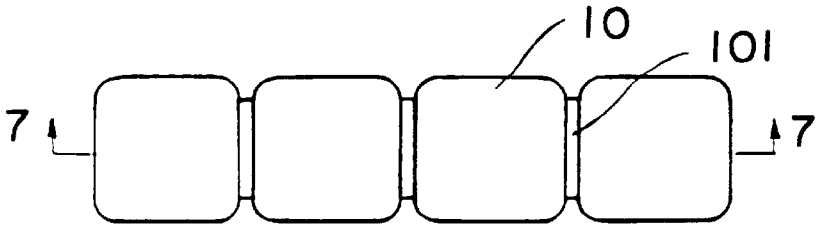
FIG. 5
FIG.6
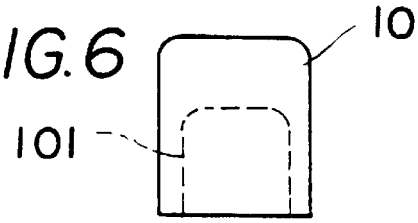
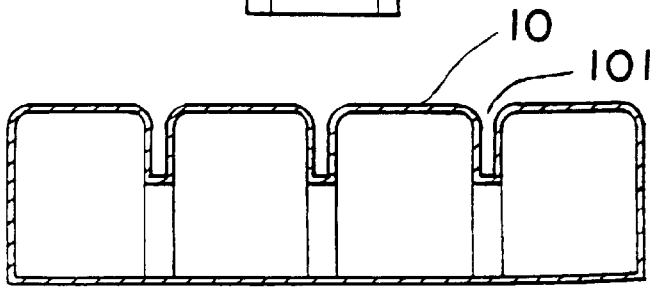
FIG. 7

FIG. 16
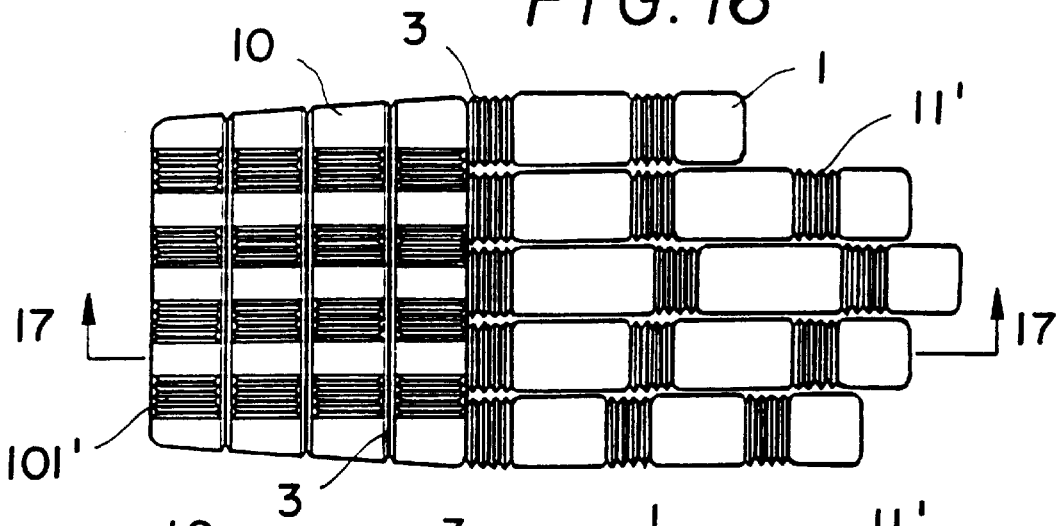
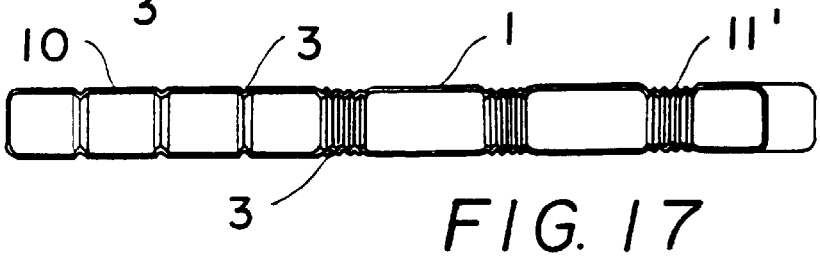
FIG. 17
FIG. 18
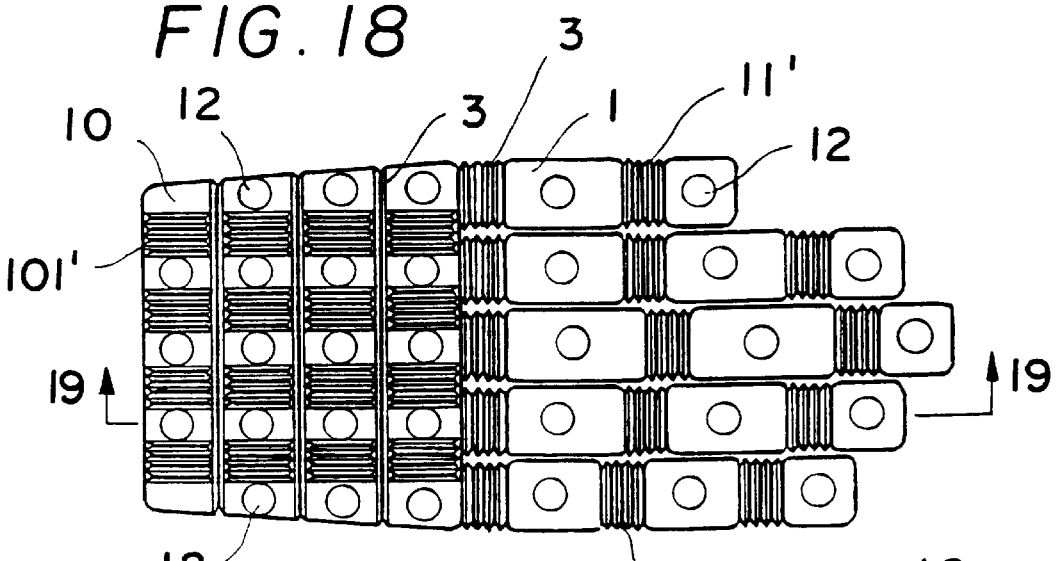
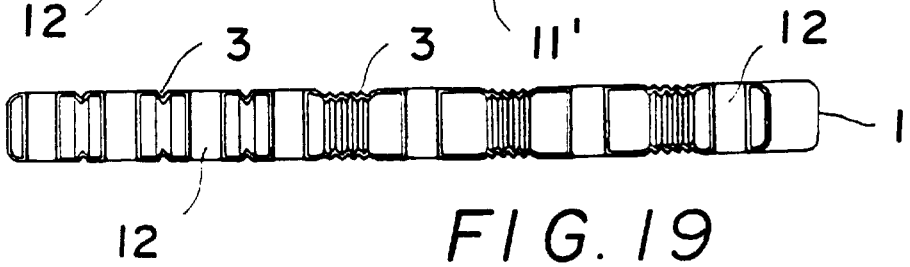
FIG. 19

PROTECTIVE AIR CUSHION GLOVES

This application is a continuation of 08/876,491 filed on Jun. 16, 1997 now U.S. Pat. No. 6,065,150.

BACKGROUND OF THE INVENTION

Common sports protective gloves such as those for hockey include a layer of foam rubber disposed in a back portion of the gloves for protecting the back of a hand, and protecting arm and fingers by means of a foam rubber layer. However, the thickness of the foam rubber layer is limited, and also its elasticity is limited, hardly effective to prevent harm or injury if the striking force is large. If the striking point is on the part where there is no foam rubber, the injury will be very serious.

SUMMARY OF THE INVENTION

Protective air cushion gloves according to the present invention have been devised with the following objects.

1. To offer protective gloves having air cushions functioning as buffer shock-absorbing means.

2. To offer protective gloves having excellent flexibility, a natural curvature for air cushions disposed in the gloves, with light weight and ease of handling.

3. To offer protective gloves having wholeness of air cushions disposed in the gloves, and extensible tubes added in each air cushion to permit the gloves to be very flexible to bend.

4. To offer protective gloves having buffer air cushions with flexible joints for completely protecting a hand.

BRIEF DESCRIPTION OF THE DRAWINGS

This invention will be better understood by referring to the accompanying drawings, wherein:

FIG. 2 is an elevational view of a straight air cushion for a finger;

FIG. 3 is a right side view of FIG. 2;

FIG. 4 is a cross-sectional view taken along line 4—4 in FIG. 2;

FIG. 5 is an elevational view of an air cushion for the back of a hand back;

FIG. 6 is a right side view of FIG. 5;

FIG. 7 is a cross-sectional view taken along line 7—7 in FIG. 5;

FIG. 16 is an elevational view of a first preferred embodiment of a single integral air cushion according to the present invention;

FIG. 17 is a cross-sectional view taken along line 17—17 in FIG. 16;

FIG. 18 is an elevational view of a second preferred embodiment of a single integral air cushion according to the present invention; and, FIG. 19 is a cross-sectional view taken along line 19—19 in FIG. 18.

DETAILED DESCRIPTION OF THE PREFERRED EMBODIMENT

Figure 1:
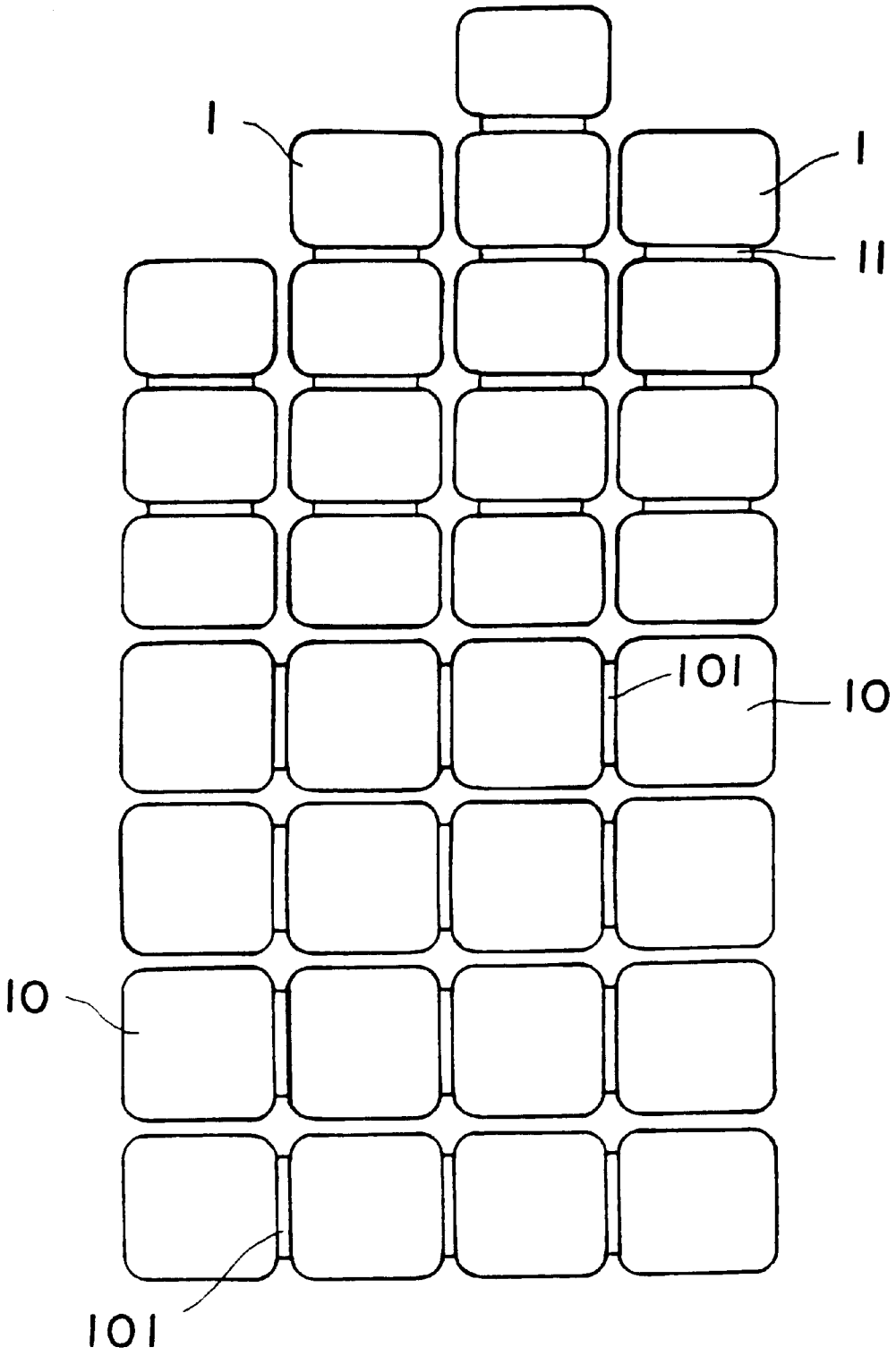
FIG. 1 is an elevational view of straight air cushions for finger backs arranged in rows for protective air cushion gloves according to the present invention.

Referring to FIGS. 1 and 16, hollow 3D air cushions disposed in protective air cushion gloves in the present invention are located in regular rows as shown in FIG. 1, or may be directly formed into single integral air cushion shown in FIG. 16 in a protective air cushion glove. Hollow 3D straight air cushions are divided into first straight air cushions 1 for protecting finger backs and second straight air cushions 10 for the back of a hand. The first straight air cushions 1 for finger backs have elongate grooves 11 in an upper surface or the upper surface and two sides, is providing the first straight air cushions 1 with flexibility. FIG. 4 shows its cross-sectional view.

The second straight air cushions 10 for a hand back are also provided with elongate grooves 101 in the upper surface, or the upper surface and two sides, or the upper surface, a lower surface and the two sides, permitting the second straight air cushions 10 to have flexibility. Its cross-section is shown in FIG. 7.

Further, the lower end of each first hollow 3D straight air cushion 1 for a finger back may be provided with a sloped surface 12, which can be utilized to face and hide an aperture when the lower end of a first straight air cushion 1 abuts a second straight air cushion 10 for a hand back.

Figure 8:
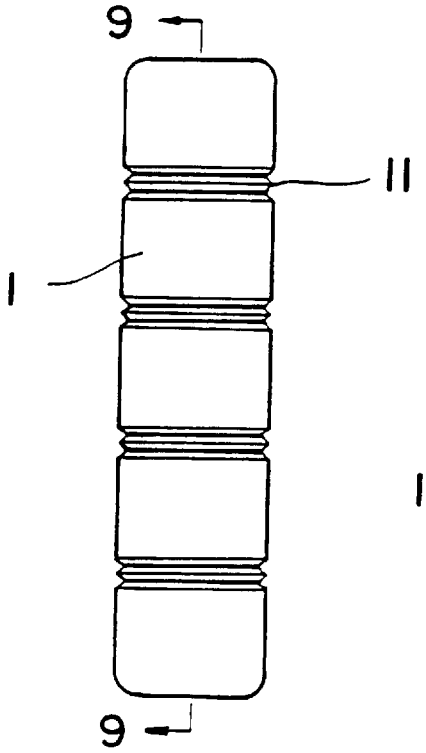
FIG. 8 is an elevational view of the straight air cushion of FIG. 2, additionally provided with extensible tubes.
Figure 9:
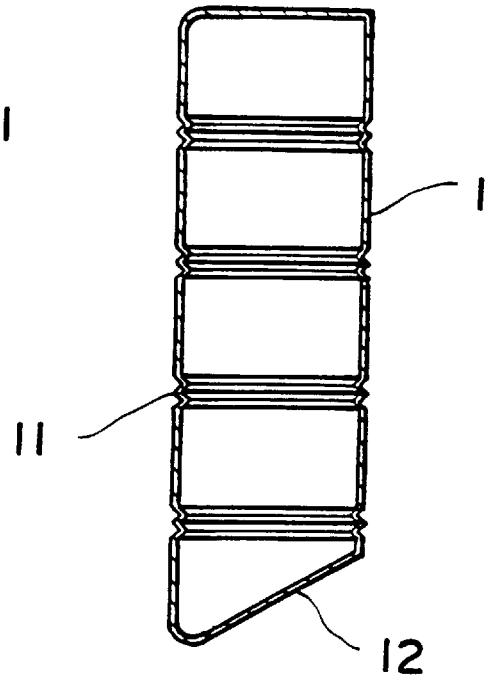
FIG. 9 is a cross-sectional view taken along line 9—9 in FIG. 8.
Figure 10:
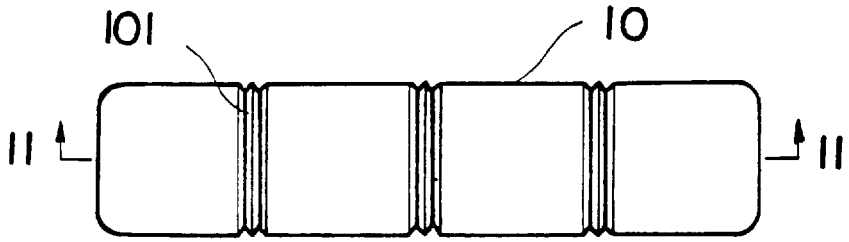
FIG. 10 is an elevational view of the air cushion for the back of a hand in FIG. 5, additionally provided with extensible tubes.
Figure 11:
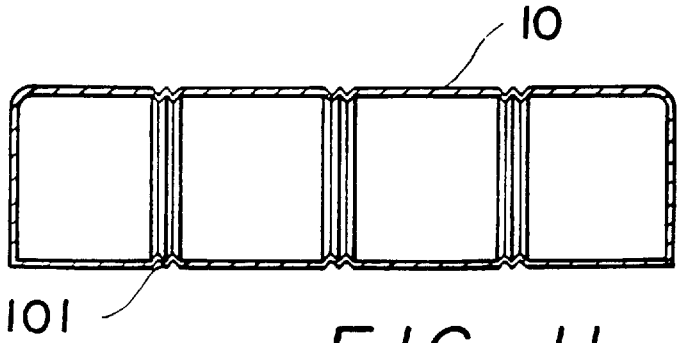
FIG. 11 is a cross-sectional view taken along line 11—11 in FIG. 10.

Referring to FIGS. 8 and 10, the elongate grooves 11, 101 shown in FIGS. 2 and 5 form extensible tubes 11, 101 so as to obtain flexibility in various directions.

Figure 12:
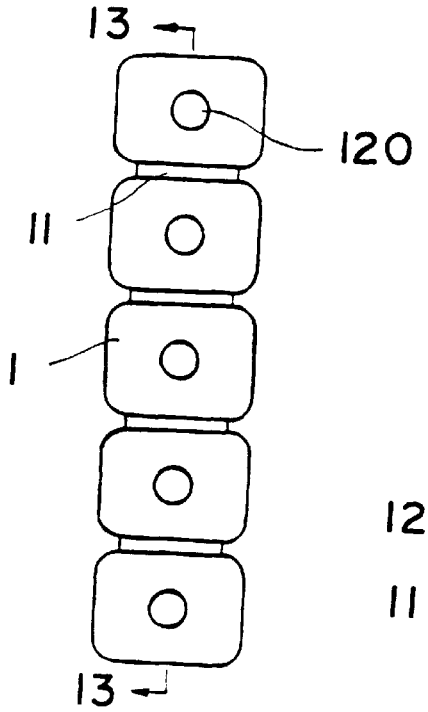
FIG. 12 is an elevational view of a straight air cushion provided with recessed holes in two surfaces according to the present invention.
Figure 13:
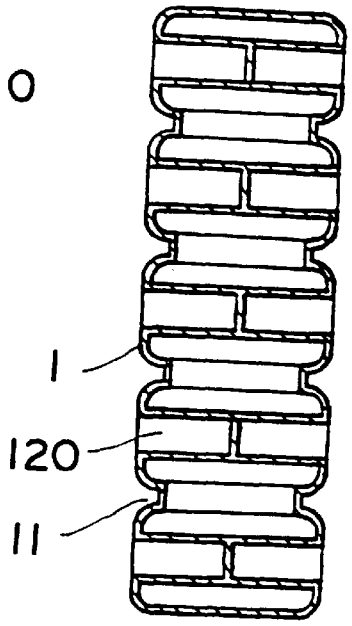
FIG. 13 is a cross-sectional view taken along line 13—13 in FIG. 12.
Figure 14:
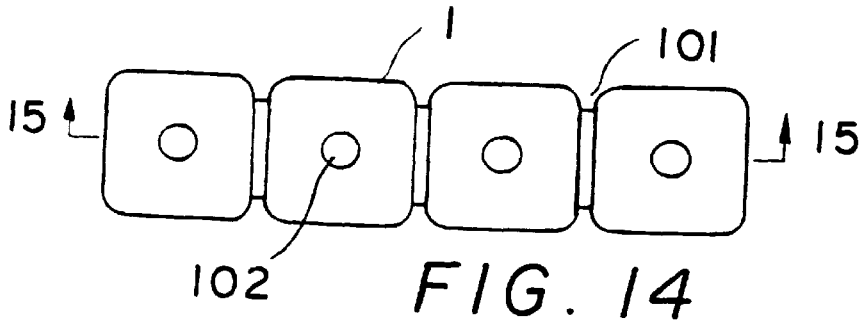
FIG. 14 is an elevational view of a straight air cushion provided with through holes according to the present invention.
Figure 15:
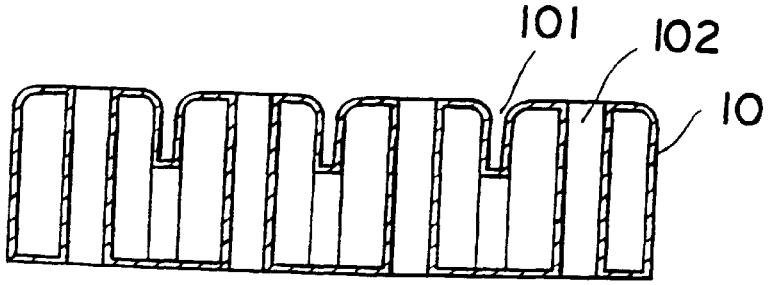
FIG. 15 is a cross-sectional view taken along line 15—15 in FIG. 14.

Referring to FIGS. 12 and 13, recessed holes 12 are additionally provided vertically in an upper surface and a lower surface or on two—left and right—sides of the first air cushions 1 for finger backs and the second air cushions 10 for a hand back shown in FIGS. 2 and 5. Then the first air cushions 1 and the second air cushions 10 are provided with a structure formed by the elongate grooves 11 and 101 and the recessed holes 12 functioning as post-shaped ribs so that comparatively high inner pressure may be filled inside. Besides, the recessed holes 12 and 102 may be formed only in one surface half through or wholly through as shown in FIGS. 14 and 15.

FIGS. 16 and 18 show that the first air cushion 1 and the second air cushions 10 are not disposed in a completely straight line. The extensible tubes 3 used to connect sections of each first air cushion 1 and sections of each second air cushion 10 with a common interior completely through, and not separated. Consequently, the single integrated air cushion has excellent flexibility owing to the extensible tubes 3.

The single integrated air cushion shown in FIG. 18 has the extensible tubes 3 connecting sections of each first air cushion 1 and each second air cushion 10, and in addition has recessed holes 12 and 102 in one surface or two surfaces, permitting the whole air cushions have flexibility and shape-memorable structure.

As to the extensible tubes 11', 101' and 3, they can provide not only flexibility for bending, but also can be connected without apertures in the first and the second straight air cushions 1 and 10 so as to furnish complete protection.

Each straight air cushion 1 or 10 can be filled a gas, a fluid, a semi-fluid, a liquid, or a low-percolating large particle gas such as SF6, C2F6, etc.

In general, the protective air cushion gloves according to the present invention not only have better resilience than traditional ones made of sponge, or foam rubber, but also have an excellent shape-memorable structure obtained from the recessed holes and the elongate grooves so that the first and the second straight air cushions can be inflated to high inner pressure, and are not liable to disfigure. In addition, the recessed holes and the elongate grooves function as ribs so as to furnish the protective air cushion gloves with excellent flexibility, and shock-absorbing effect.

While the preferred embodiments of the invention have been described above, it will be recognized and understood that various modifications may be made therein and the appended claims are intended to cover all such modifications which may fall within the spirit and scope of the invention.

What is claimed is:

1. A protective air cushion for gloves comprising a plurality of first preformed hollow three-dimensional straight air cushions for finger backs, and a plurality of second preformed hollow three-dimensional straight air cushions for a hand back, and having at least one recessed hole in a surface, said recessed hole being formed at least half-through said straight air cushion, the recessed hole being defined by a shape-memorable wall structure for permitting the cushion to be inflated to a high inner pressure and without being disfigured.

2. The protective air cushion for gloves as claimed in claim 1, further including a plurality of recessed holes, and at least one of said recessed holes is in an upper surface and a lower surface to respectively face each other.

3. The protective air cushion for gloves as claimed in claim 1 wherein at least one of said first and second air cushions is filled with a fluid.

4. The protective air cushion for gloves as claimed in claim 3 wherein said fluid is a gas.

5. The protective air cushion for gloves as claimed in claim 1 wherein at least one of said hollow three-dimensional straight air cushions includes at least one elongate groove in an upper surface to provide the at least one hollow three-dimensional straight air cushion with flexibility.

6. The protective air cushion for gloves as claimed in claim 5 wherein said at least one groove extends from said upper surface along at least a one side surface.

7. A protective air cushion for gloves comprising a plurality of first preformed hollow three-dimensional straight air cushions for a first portion of a glove, and a plurality of second preformed hollow three-dimensional straight air cushions for a second portion of a glove, having at least one recessed hole in a surface of one straight air cushion, said recessed hole being formed at least half-through said one straight air cushion, the recessed hole being defined by a shape-memorable wall structure for permitting the cushion to be inflated to a high inner pressure and without being disfigured.

8. A protective air cushion for gloves comprising a plurality of first preformed hollow three-dimensional straight air cushions for finger backs, and a plurality of second preformed hollow three-dimensional straight air cushions for a hand back, at least one recessed hole in a surface of one straight air cushion, said one recessed hole being formed at least half-through said straight air cushion, the recessed hole being defined by a shape-memorable wall structure for permitting the cushion to be inflated to a high inner pressure and without being disfigured, and wherein said first and second straight cushions are connected by a plurality of sections having a plurality of elongate grooves in an upper surface thereof so as to form a single integral air cushion.

9. A protective cushion for gloves comprising a plurality of first preformed hollow three-dimensional straight cushions for finger backs, and a plurality of second preformed hollow three-dimensional straight cushions for a hand back, at least one recessed hole in a surface of one straight cushion, said one recessed hole being formed at least half-through said straight cushion, the recessed hole being defined by a shape-memorable wall structure for permitting the cushion to be inflated to a high inner pressure and without being disfigured, and wherein at least one of said first and second cushions is filled with a liquid.

10. A protective air cushion for gloves comprising a plurality of first preformed hollow three-dimensional straight air cushions for a first portion of a glove, and a plurality of second preformed hollow three-dimensional straight air cushions for a second portion of the glove, at least one recessed hole in a surface of one straight cushion, said recessed hole being formed at least half-through said one straight cushion, the recessed hole being defined by a shape-memorable wall structure for permitting the cushion to be inflated to a high inner pressure and without being disfigured, and wherein said first and second straight air cushions are connected by a plurality of sections having a plurality of elongate grooves in an upper surface thereof so as to form a single integral air cushion.

* * * * *